US011040924B1

(12) United States Patent
Castellanos et al.

(10) Patent No.: US 11,040,924 B1
(45) Date of Patent: Jun. 22, 2021

(54) PROCESS FOR ADDITIVELY MANUFACTURING DISCRETE GRADIENT CHARGES

(71) Applicants: Jorge Castellanos, LaPlata, MD (US); Demitrios Stamatis, LaPlata, MD (US); Samuel B. Emery, Alexandria, VA (US); David O. Zamor, Port Tobacco, MD (US); Meagan E. Gay, Alexandria, VA (US); George W. McDaniel, Jr., Alexandria, VA (US); Austin W. Riggins, Knoxville, TN (US)

(72) Inventors: Jorge Castellanos, LaPlata, MD (US); Demitrios Stamatis, LaPlata, MD (US); Samuel B. Emery, Alexandria, VA (US); David O. Zamor, Port Tobacco, MD (US); Meagan E. Gay, Alexandria, VA (US); George W. McDaniel, Jr., Alexandria, VA (US); Austin W. Riggins, Knoxville, TN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 425 days.

(21) Appl. No.: 15/999,998

(22) Filed: Sep. 17, 2018

(51) Int. Cl.

| | |
|---|---|
| ***C06B 45/10*** | (2006.01) |
| ***C06B 45/00*** | (2006.01) |
| *C06B 45/06* | (2006.01) |
| *C06B 45/04* | (2006.01) |
| *D03D 23/00* | (2006.01) |
| *C06B 43/00* | (2006.01) |

(52) U.S. Cl.
CPC ..... *C06B 45/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,132,170 | A | 1/1979 | Hardy et al. | |
| 9,109,865 | B2 * | 8/2015 | Haskins | F42B 12/207 |
| 9,453,479 | B1 * | 9/2016 | Jones | B33Y 80/00 |
| 9,822,045 | B2 | 11/2017 | Jones | |
| 2017/0073280 | A1 * | 3/2017 | Jones | C06B 21/0075 |

(Continued)

OTHER PUBLICATIONS http://manufacturingscience.asmedidigitalcollection.asme.org Additive Manufacturing: Current State, Future Potential, Gaps and Needs, and Recommendations; Yong Huang et al.

(Continued)

*Primary Examiner* — James E McDonough
(74) *Attorney, Agent, or Firm* — Fredric J. Zimmerman

(57) ABSTRACT

A discrete gradient charge that has a discrete first hollow cylindrical layer of a solid first fuel, which is about 85% by weight fine aluminum powder having a median diameter of about 3.5 microns. There is a discrete second hollow cylindrical layer of a solid second fuel that is about 80% by weight coarse aluminum powder with a median diameter of about 31.0 microns. The fuels have a cured HTPB binder. A pellet of an explosive positioned within the first hollow cylindrical layer provides ignition. The fuel in the charge reacts with the surrounding air or with a hollow cylindrical oxidizer layer, or a combination thereof.

20 Claims, 8 Drawing Sheets

(56) References Cited

U.S. PATENT DOCUMENTS

2018/0141273 A1 5/2018 Santiago et al.

OTHER PUBLICATIONS https://www.researchgate.net/publication/2168334166 Comparison of Thermal Behavior of Regular and Ultra-fine Aluminum Powders (Alex) Made from Plasma Explosion Process Combustion Science and Technology 135(1):269-292, Jun. 1998 DOI: 10.1080/00102209808924161.

www.mixing.net/Conferences/mix22/abstracts/Peter Lucon.pdf Mixing XXII North American Mixing Forum, Jun. 20-25, 2010 Victoria, BC Canada Low-Frequency Acoustic Mixing of Complex and Multiphase Systems.

* cited by examiner

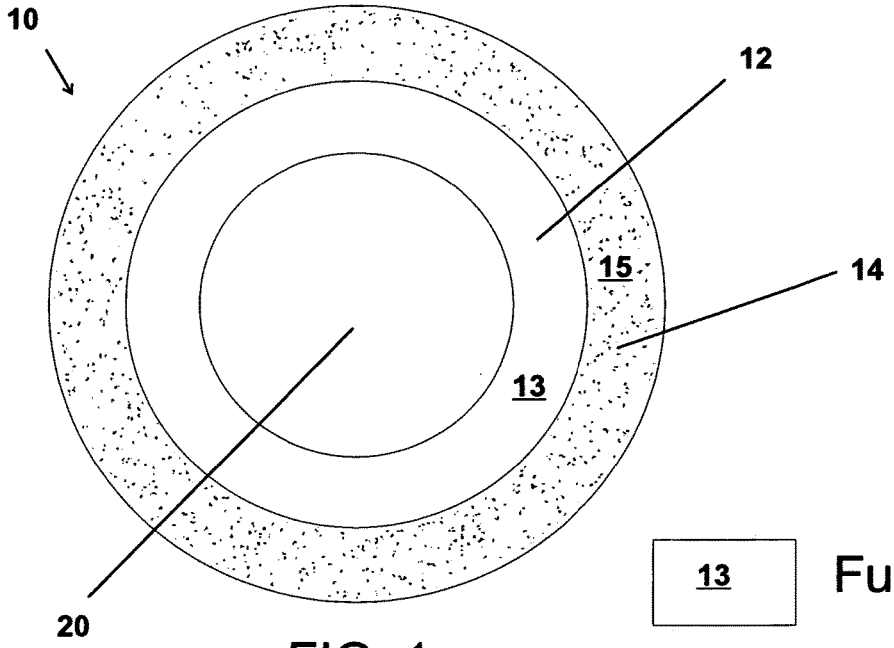
FIG. 1
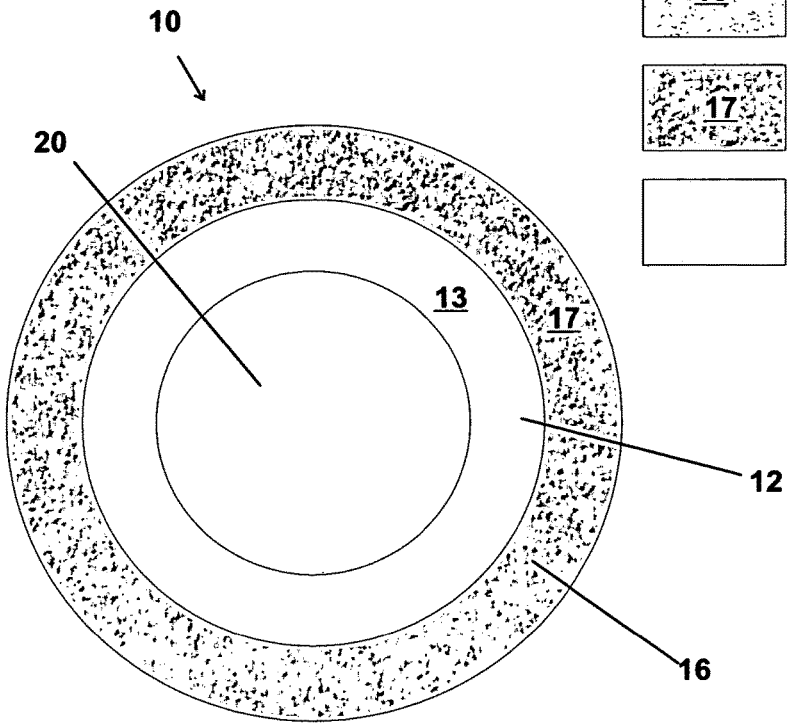
FIG. 2
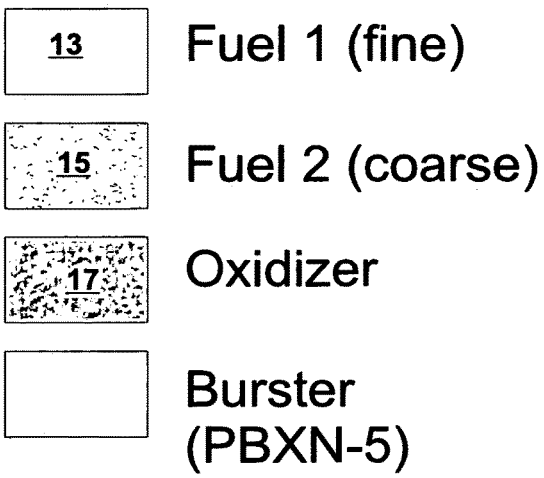

FIG. 6A

Additive manufacturing (AM) a gradient discrete charge having at least one discreet layer of a first fuel with a fine aluminum powder with a median diameter of about 3.5 microns, wherein about 90% is less than or equal to about 7.5 microns, and only about 10% is less than or equal to about 1.8 microns.

↓ combining first fuel components that include: the fine aluminum powder and a curable binder, therein forming a first paste that is about 85% solids;

↓ building by additive manufacturing a discrete first layer that has a hollow first fuel cylindrical form with a first fuel diameter by extruding a first fuel circular coiled stream of the first paste with a a first fuel series of continuous overlapping passes of the first paste until a desired height is attained; and

↓ allowing the first fuel series of continuous overlapping passes of the first paste to meld and cure into a solid discrete inner layer of the first fuel.

FIG. 6B Stop ←↓→ FIG. 6C adding a second fuel with a coarse gradient aluminum powder with a median diameter of about 31.0 microns, wherein about 90% is less than or equal to about 58.0 microns, and only about 10% is less than or equal to about 15.0 microns;

↓ combining second fuels components that include: the coarse gradient aluminum powder and the curable binder, therein forming a second paste that is about 80% solids;

↓ building by additive manufacturing another discrete layer of second fuel that has a second fuel hollow cylindrical form with a second fuel diameter, which is greater than the diameter of a previous layer, by extruding the second paste also as a circular coiled stream with a second fuel series of continuous overlapping passes of the second paste until the desired height is attained; and

↓ allowing the series of continuous overlapping passes of the second paste to meld and cure into the solid discrete layer of the second fuel.

↳ Stop

PROCESS FOR ADDITIVELY MANUFACTURING DISCRETE GRADIENT CHARGES

STATEMENT OF GOVERNMENT INTEREST

The invention described herein may be manufactured and used by or for the Government of the United States of America for Governmental purposes without the payment of any royalties thereon or therefore.

FIELD OF THE INVENTION

The invention relates generally to fast burning charges, and more particularly to a process for making discrete gradient charges, where each charge has at least one discrete layer with a gradient fuel, wherein the discrete gradient charges have a sustained burn in air, oxidizer layer or combination thereof following ignition.

BACKGROUND OF THE INVENTION

In the related art, solid propellants typically employ a fuel having a military grade of aluminum powder that is at least about 44 microns, a oxidizer such ammonium perchlorate, and a binder such as hydroxyl-terminated polybutadiene (HTPB). A typical HTPB has oligomeric units, which are chain-like, typically containing 40-50 butadiene molecules, with each end of the chain terminated with a hydroxyl group.

In most cases the oxidizer of solid propellants is intimately admixed with the binder and the aluminum, and there is sufficient oxidizer to covert the element aluminum to aluminum oxide, and the binder to water and carbon dioxide.

In the case of hybrid rocket propellants the oxidizer is typically in a tank forward of the fuel. Ronald D. Jones in teaches an additive manufactured thermoplastic-aluminum nanocomposite hybrid rocket fuel grain and method of manufacturing same. The hybrid rocket solid fuel grain has a cylindrical shape with a center port, and additive manufacturing (AM), which is a type of 3D printing, typically employees thermoplastic polymers to create prototypes, and occasionally, small scale manufacturing.

The fuel is additive manufactured from a compound of thermoplastic fuel and passivated nanocomposite aluminum additive. Passivation, either as controlled oxidation of the surface or coating the surface of the nanoscale aluminum is required to prevent the aluminum from spontaneously burning during incidental contact with air having oxygen and/or water vapor. The fuel grain has stack of fused layers, each formed as a plurality of fused abutting concentric circular beaded structures of different radii arrayed defining a center port.

In operation of a hybrid rocket, the oxidizer is introduced along the center port, with combustion occurring along the exposed port wall. Each circular beaded structure possesses geometry that increases the surface area available for combustion. As each layer ablates the next abutting layer, exhibiting a similar geometry is revealed, undergoes a gas phase change, and ablates. This process repeats and persists until oxidizer flow is terminated or the fuel grain material is exhausted. As previously discussed, to safely achieve this construction; a fused deposition is added to shield the nanocomposite material from the atmosphere.

In other applications of energetic materials, a thermobaric weapon, typically a warhead, is a type of explosive that uses oxygen from the surrounding air to generate a high-temperature explosion. The blast wave produced by a thermobaric weapon is of a significantly longer duration than that produced by a conventional condensed explosive, wherein condensed explosives do not require ambient air.

The fuel-air bomb is one of the best-known types of thermobaric weapons. U.S. Pat. No. 4,132,170 teaches a fuel-air type bomb, which contains a liquid fuel normally non-explosive, with a bursting charge centrally located within the fuel. The bursting charge, upon firing, shocks the fuel into a highly reactive mixture with the surrounding air while simultaneously disseminating the fuel at a supersonic rate over a large area, which causes increasing blast effects.

In another variation, as taught in U.S. Pat. No. 9,109,865, a cylindrical warhead contains an inner high performance high explosive composition based on HMX, then a layer of a 10.5 micron aluminum powder which in size is somewhere between fine and coarse, and an outer highly aluminized explosive composition of RDX and cured binder.

SUMMARY OF THE INVENTION

The invention is a discrete gradient charge with at least one discrete layer of fuel, and a process for making the discrete gradient charge. Following ignition, the at least one discrete layer of fuel has a sustained burn in air. The discrete gradient charge typically has a plurality of discrete layers, wherein a first layer of fuel includes fine aluminum powder, and optionally a second layer of fuel that includes coarse aluminum powder. Ignition of the charge is effected by an initiating explosive, wherein the at least one layer of fuel is oxidized by air, by a discrete layer of an oxidizer, or by a combination thereof.

A first aspect of the invention is that the fine aluminum powder has a median spherical diameter of about 3.5 microns, which is substantially larger than nanometer particle sized aluminum. Nanometer particle sized aluminum is typically oxidized in air.

A second aspect of the invention is that the first fuel contains a polymeric binder, wherein following extrusion of the first fuel as a paste, the paste cures forming the discrete gradient charge with a solid fuel.

A third aspect of the invention is that if the discrete gradient charge has only a single layer of solid fuel having only coarse aluminum powder, then the discrete gradient charge will not have a sustained burn in air.

A fourth aspect of the invention is that even if about half of the coarse aluminum powder is replaced with fine aluminum powder forming a blended fuel, a discrete gradient charge having only a single layer of the blended fuel will still not have a reliable sustained burn.

A fifth aspect of the invention is that when the discrete gradient charge has a second discrete layer of a second fuel with a coarse aluminum powder and an underlying first discrete layer of the first fuel a with fine aluminum powder, then the gradient charge has a sustained burn.

A sixth aspect of the invention is that overlapping the first discrete layer of the first fuel with an outer discrete layer of an oxidizer causes the discrete gradient charge to burn faster. The outer discrete layer of the oxidizer can include components that release specialized vapors, for example iodine, which is a biocide.

A seventh aspect of the invention is that the fuel nominally does not include an explosive energetic material like HMX or RDX, as it is not needed and generally is less suitable for Additive Manufacturing in which a stream of material is that deposited.

A final aspect of the invention is that Additive Manufacturing (AM), using a 3D printer, can be used to make prototypes or scaled up to manufacture the discrete gradient charges.

BRIEF DESCRIPTION OF THE DRAWINGS

The foregoing invention will become readily apparent by referring to the following detailed description and the appended drawings in which:

FIG. 1 is an overhead sectional view of a discrete gradient charge having a center explosive pellet of PBXN-5 (95% octahydro-tetranitrotetrazine (HMX) by weight with 5% Viton-A binder), a second discrete outer layer of a second fuel that includes coarse aluminum powder and an underlying first discrete layer of the first fuel that includes fine aluminum powder;

FIG. 2 is an overhead sectional view of a discrete gradient charge having a center explosive pellet of PBXN-5, an outer discrete oxidizer layer, for example bismuth triiodate, and an underlying first discrete layer of the first fuel that includes fine aluminum powder;

FIG. 6A, FIG. 6B and FIG. 6C is a flow chart for the process for making a plurality of possible embodiments of the discrete gradient charge, wherein the first layer is always the first fuel of fine aluminum powder suspended in a binder, which optionally is followed by another discrete layer of either a second layer of fuel that includes coarse aluminum powder; or an oxidizer layer of an oxidant. The test results indicate that variations having at least three discrete layers are plausible, wherein the oxidizer layer is between the first fuel layer and the second fuel layer.

DETAILED DESCRIPTION OF THE INVENTION

The invention is a discrete gradient charge and a process for making discrete gradient charges having at least one fuel which, where the charge upon ignition, has a sustained burn in air. The charge has at least one discrete layer, wherein a first layer includes a first fuel having fine aluminum powder. Upon ignition by an explosive, the first fuel burns rapidly in air.

An example of the first fuel having a particular fine aluminum powder that is well characterized is exemplified by Valimet™ H-2. The median diameter of H-2 is about 3.5 microns, wherein about 90% is less than or equal to 7.5 microns, and only about 10% is less than or equal to 1.8 microns. In contrast, a coarse aluminum powder is Valimet™ H-30. The median diameter of H-30 is about 31.0 microns, wherein about 90% is less than or equal to 58.0 microns, and only about 10% is less than or equal to about 15.0 microns. The Valimet™ aluminum powders are about spherical and the measured equivalent spherical diameter (ESD) percent unit is volume percent.

Figure 2A:
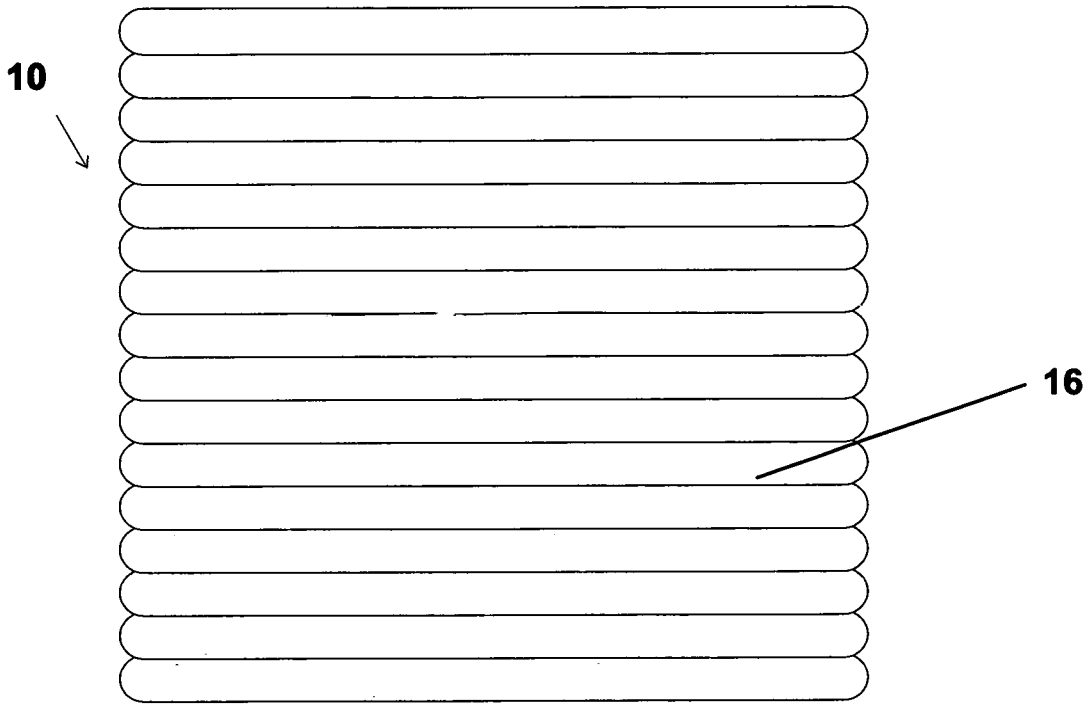
FIG. 2*a* is a side view of the discrete gradient charge shown in FIG. 2.
Figure 1A:
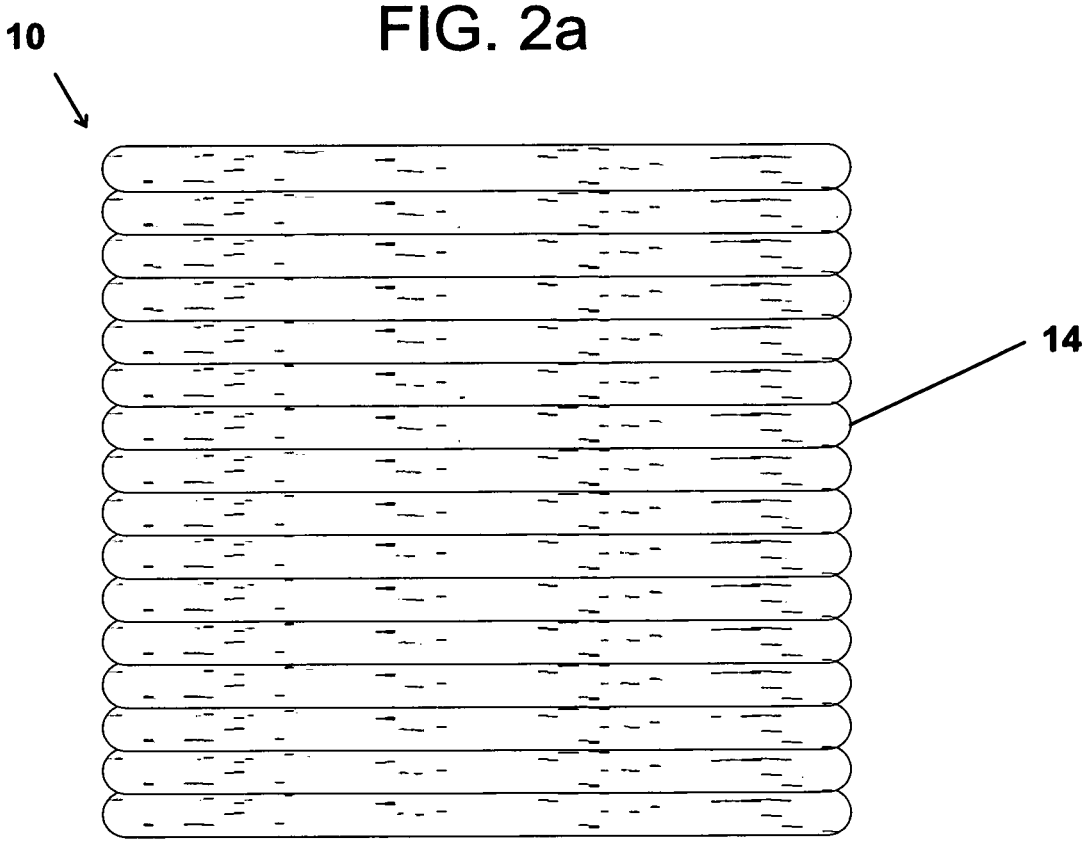
FIG. 1*a* is a side view of the gradient discrete charge shown in FIG. 1.

In at least one embodiment, the process utilizes a computer controlled gantry or 3D printer to additively manufacture (AM) the charge. In an experimental setup, the computer controlled gantry or 3D printer (e.g. Stratasys F900™) using fused deposition modeling is fitted with a piston driven syringe, a nozzle and optional rotary valve. The flow rate of material though the nozzle is controlled by a rotary valve controller (e.g. RVC900N made by Fisnar™) and a compensatory line speed (~2 mm/s) is determined for the computer controlled gantry or 3D printer. Where programmed to do so, a stream of material is continuously laid down, and a discrete layer is vertically formed by overlaying a series of continuous passes of the stream of the material. For example, as shown in FIG. 1*a* and FIG. 2*a*, a discrete layer having a hollow cylindrical form with a first diameter is formed by extruding a circular coiled stream of material. After the first pass, each subsequent pass stacks material onto the previous pass.

Figure 6C:
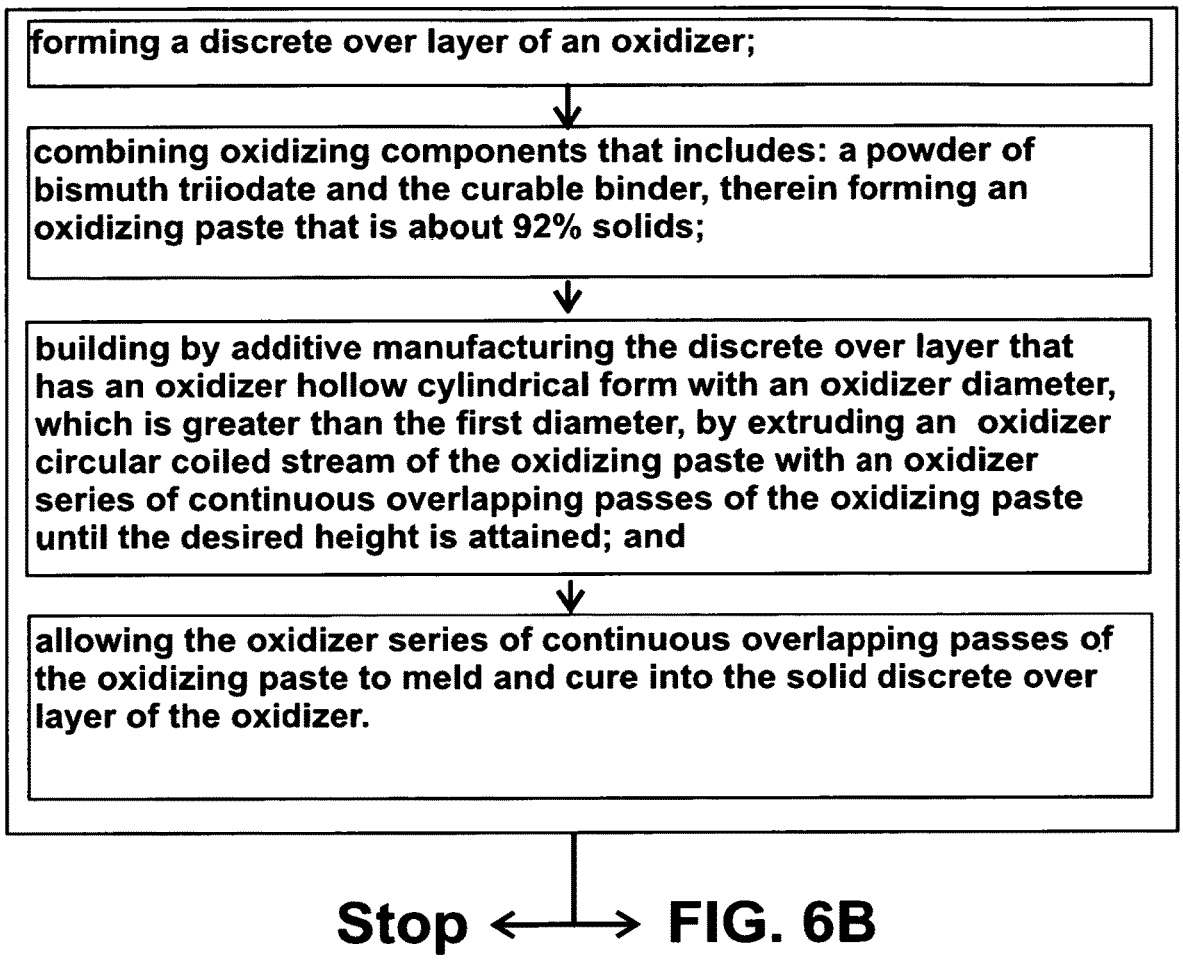

The process for forming several embodiments of the discrete gradient charge that have a sustained burn is illustrated FIG. 6A, FIG. 6B and FIG. 6C as a flow chart. While not explicitly described, the components of the fuels and oxidizer are acoustically mixed at a frequency of about 60 Hz, and an explosive pellet is added to initiate burning.

The discrete layer of material is deposited with multiple continuous passes until the desired height is attained. In the illustrations the desired height takes about 16 continuous passes of the stream of material, the coiled material melds together, and after several hours, it cures into a solid hollow cylinder. A center explosive pellet 20 as shown in FIG. 1 and FIG. 2 can be added before the material becomes solid, or added at a later time.

A second discrete layer having a larger diameter can be similarly formed by extruding a second circular coiled stream of material, except though a greater diameter.

Optionally, there can be one or more additional discrete layers having incrementally larger diameters. Similarly, the one or more additional discrete layers are formed by extruding a progressively larger circular coiled stream of material, with incrementally larger diameters.

The process is not limited to forming the discrete layers in any particular order.

In a first embodiment, the discrete gradient charge 10 as shown in FIG. 1, has a discrete layer 12 of a first fuel 13 that includes the fine aluminum powder. In the variation, the fine aluminum powder is dispersed in a curable binder forming a paste of about 85% solids by weight. A preferred method of creating the paste is to acoustically mix the components at a frequency of about 60 Hz. An example of a curable binder is HTPB and an appropriate isocyanate, for example isophorone diisocyanate. When cured, the first fuel forms a solid first discrete layer of the fine aluminum powder, and the discrete gradient charge does not melt when heated.

Figure 7:
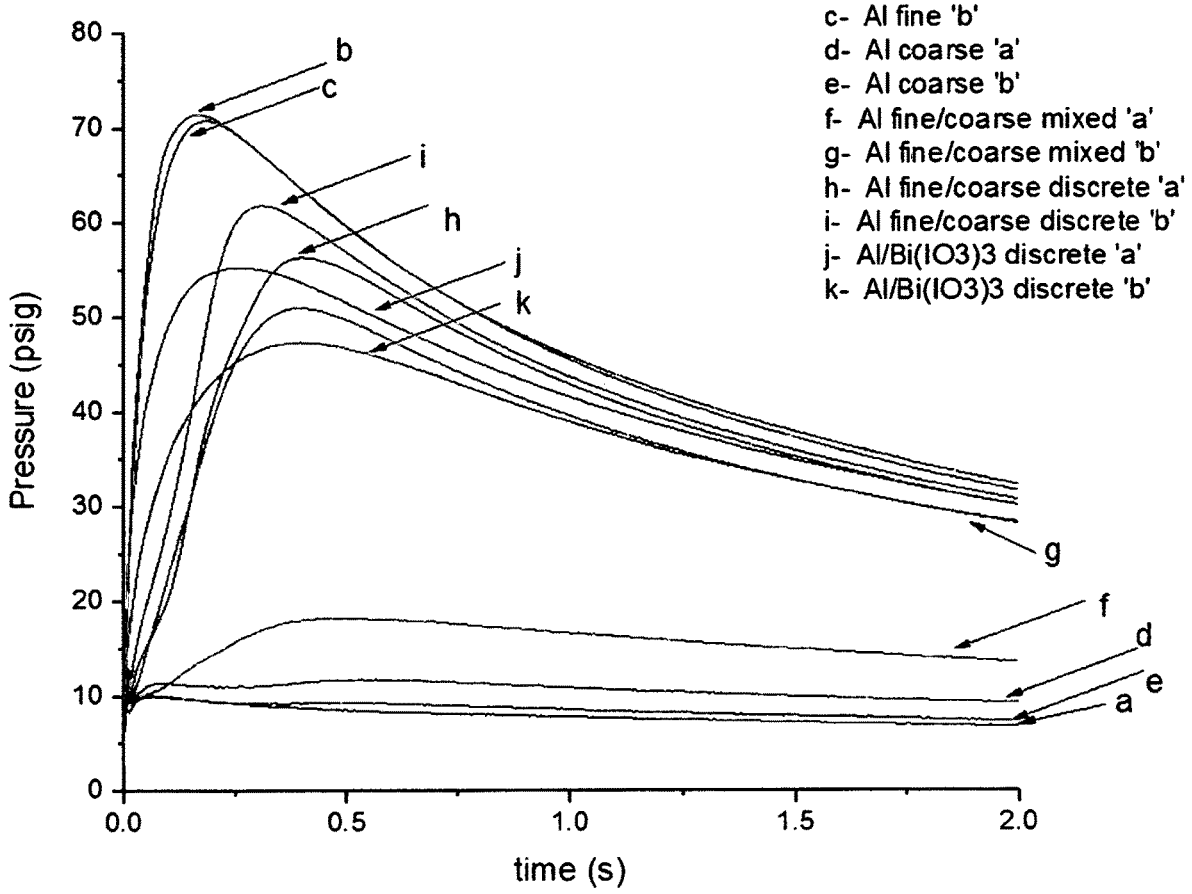
FIG. 7 is a graph illustrating the pressure increase over time following ignition of several embodiments of the discrete gradient charge, and various controls of interest.

In subsequent testing it was determined that following ignition, for example with a pellet 20 of PBXN-5, which is 95% octahydro-tetranitrotetrazine (HMX) by weight with 5% Viton-A binder, that following ignition, the first fuel has a sustained burn. As shown in FIG. 7, in the test, the burn lasted for at least 2 seconds, with a peak heat output, as indicated by the rise in pressure, at about 0.2 seconds (see line b). The test was duplicated, (see line c), and again the peak pressure was at 0.2 seconds. The sustained burn is largely the reaction of air with the first fuel 13, where the binder accounts for only a very small percent of the generated heat.

The pellet 20 of PBXN-5 can be ignited using any known ignitor, such as a blasting cap.

In a second embodiment, it was determined that if the fine aluminum powder was replaced with a coarse aluminum powder that, following ignition, there was no visible sustained burn. In FIG. 7 see curves d and e. While some heat must be generated, it is not hot enough to be in the range of the visible light spectrum, and the pressure stays at about 10 psig.

Recall that the size properties of H-2 and H-30, that there is substantially overlap. The largest H-2 is about 7.5 microns, while the smallest H-30 is about 15.0 microns. Therefore, the charge has discrete layers not only with respect to physical location, but also with respect to the size of the powder. The gradient is from fine to coarse.

It was postulated that possibly a blend of 50% H-2 and 50% H-30 in a mixed fuel might produce a sustained burn. It was found in a third embodiment that the 1:1 ratio of fine to coarse aluminum powder in a binder, did not reliably produce a visible sustained burn. As shown in FIG. 7, the charge had a sustained burn as indicated by line g, reaching at maximum pressure of about 50 psig after about 0.43 seconds, but in a second trial, shown by line f the maximum pressure was only about 18 psig after about 0.4 seconds. The mixed fuel charge is unreliable.

Figure 3:
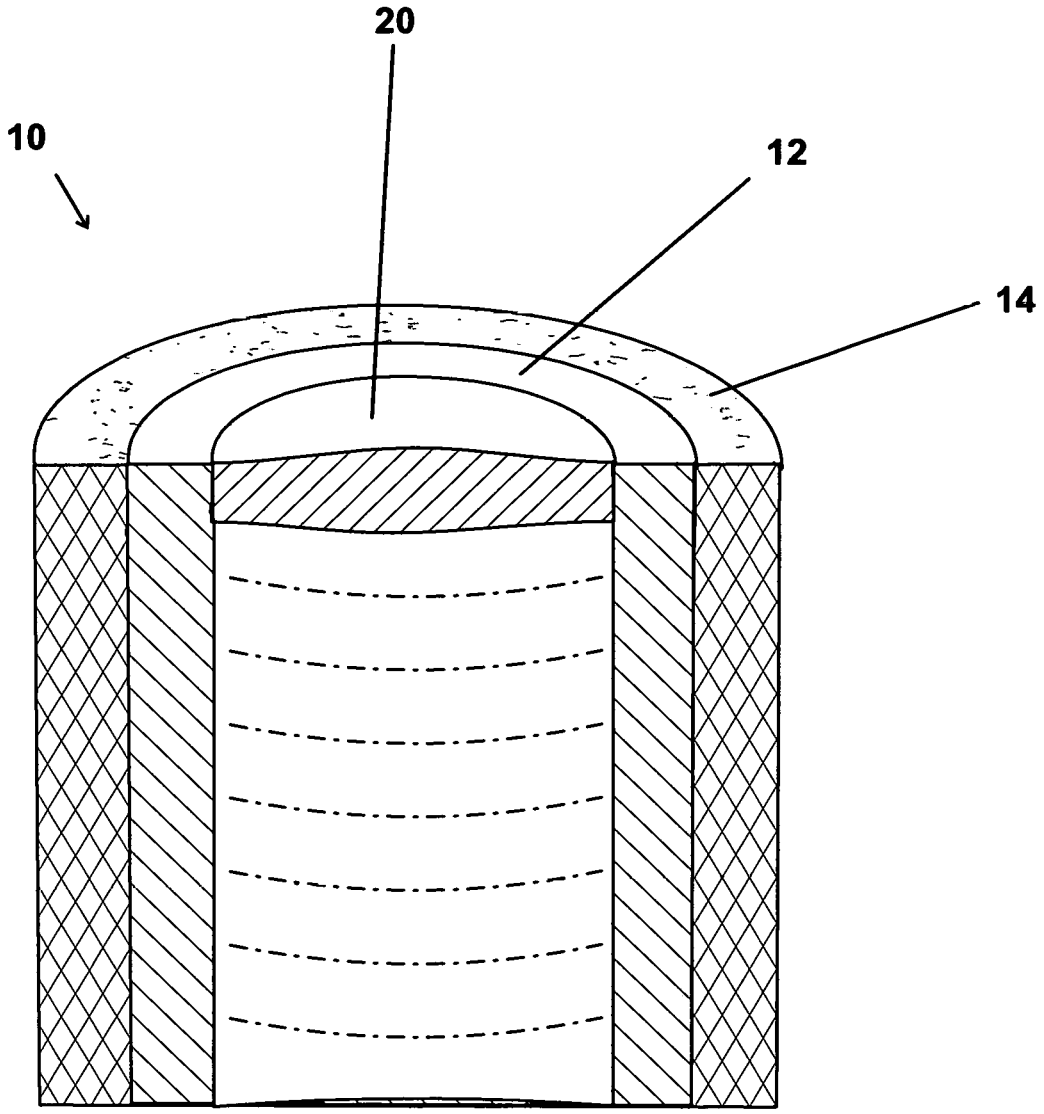
FIG. 3 is a side sectional view of the discrete gradient charge shown in FIG. 1.

In a fourth embodiment, as shown in FIG. 1, FIG. 1*a* and FIG. 3, the charge 10 has a first discrete gradient layer 12 of the first fuel 13, and an outer overlapping second discrete gradient layer 14 of a gradient coarse second fuel 15. The first fuel 13 includes fine aluminum powder dispersed in a curable binder that is a first paste having a loading of fine aluminum powder of about 85% solids by weight, and the second fuel 15 includes coarse aluminum powder dispersed in a curable binder forming a second paste that is about 80% solids by weight of coarse aluminum powder. The fourth embodiment, like the previous embodiments, was ignited with a pellet of PBXN-5.

Two trials were run, see line h and line i in FIG. 7. In h, after about 0.4 seconds the pressure had reached about 56 psig, and in line i after about 0.3 seconds the pressure had reached 62 psig. Enough heat is generated by the sustained burn of the first discrete gradient layer 12 to cause the outer overlapping second discrete gradient layer 14 to maintain the sustained burn.

In summary, using a plurality of discrete gradient layers enables coarser aluminum to be used in aluminum powder based fuels. It is probable that even a fuel having aluminum coarser than H-30 could be used. Recall, the median diameter of H-30 is about 31.0 microns, having a second gradient, wherein about 90% is less than or equal to 58.0 microns, and only about 10% is less than or equal to about 15.0 microns. Therefore, standard Military grade aluminum powder, which has a median size of 44 microns falls within the upper range of the coarse aluminum powder H-30.

As shown in FIG. 7, line a, when military grade aluminum powder is subject to an ignition by a pellet 20 of PBXN-5, there is visual evidence of some partial burning, but no evidence of any increase in pressure. Normally military grade aluminum powder is combined with a strong oxidizer, like ammonium perchlorate or a nitrate.

Figure 4:
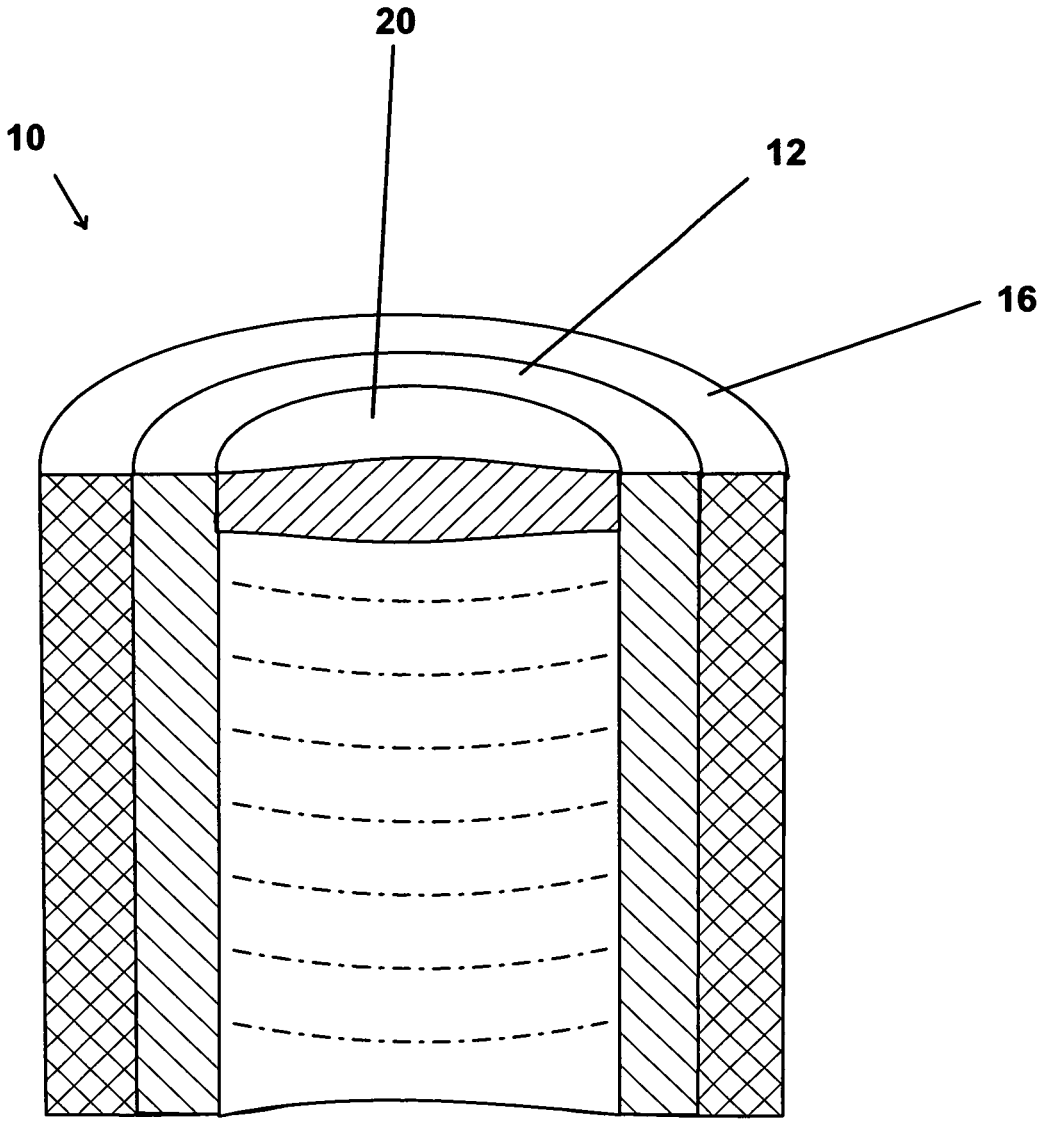
FIG. 4 is a side sectional view of the discrete gradient charge shown in FIG. 2.

The invention, in a fifth embodiment, also determined that the AM process could be used for a charge 10 that burns in air and in combination with a solid oxidizer. As shown FIG. 2, FIG. 2*a* and FIG. 4, the charge 10 has a first discrete gradient layer 12 of a first fuel 13, and an overlaying outer discrete layer 16 of an oxidizer 17. The illustrative oxidizer is about ~92% solids by weight bismuth triiodate, Bi(IO3)3, in a curable binder. The oxidizer is AM printed as an oxidizer paste in a manner previously described for the first paste and the second paste.

The high solids are possible as the atomic mass unit weight of bismuth is about 209 and iodine is about 127. Both bismuth and iodine have a much higher atomic mass than aluminum, which is about 27 atomic mass units. The iodine generated by the charge 10 upon ignition provides a very active biocide. The test results are given in FIG. 7 lines j and k.

In line j, after about 0.25 seconds the pressure had reached about 55 psig, and in line k after about 0.4 seconds the pressure had reached 45 psig. Visual images indicate that most of the charge is consumed within 0.010 seconds. The burn is closer to an explosion, with possibly incomplete burning, as the increase in pressure/heat is less than was measured for the first the first embodiment the charge.

Figure 5:
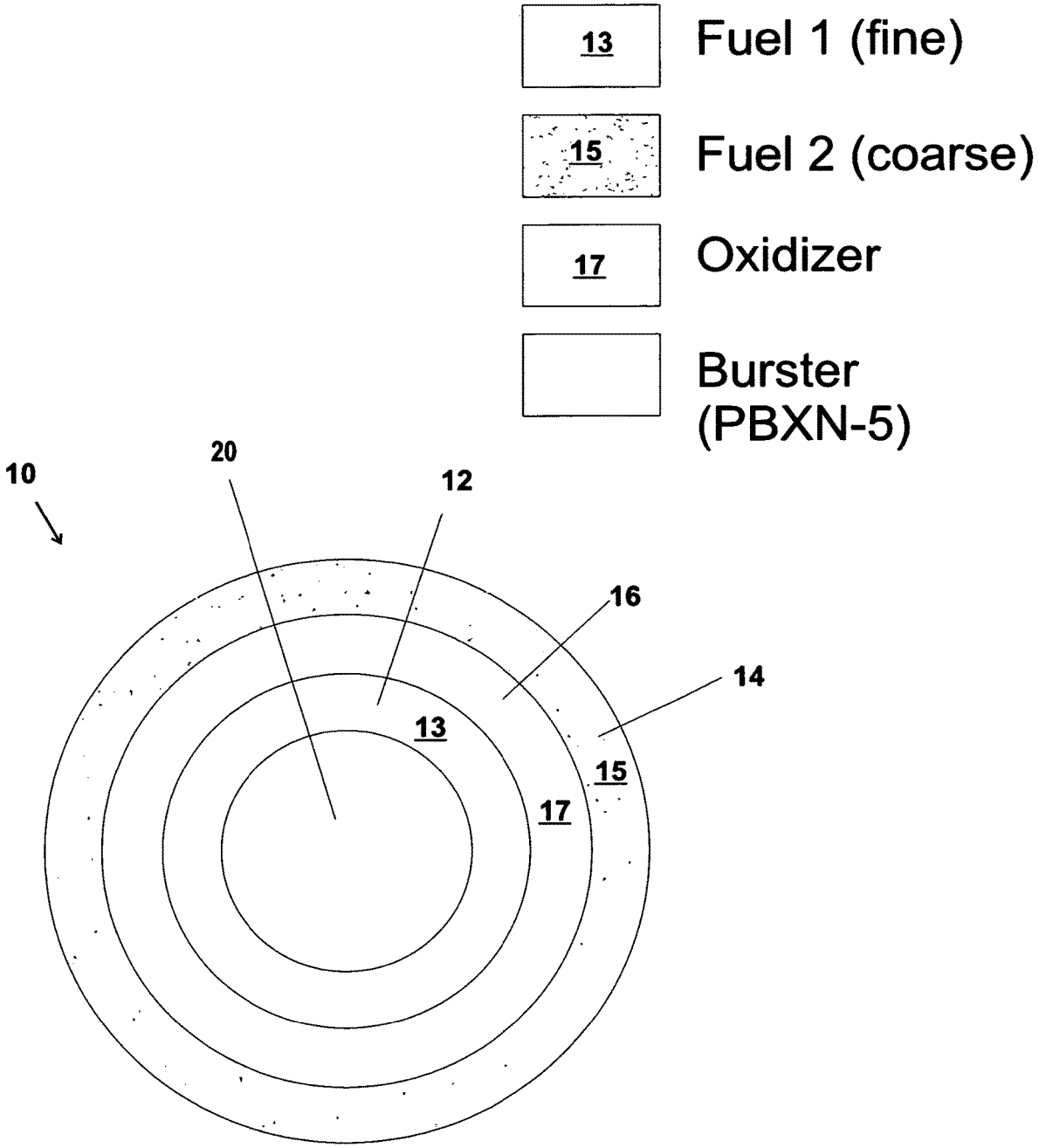
FIG. 5 is an overhead sectional view of a discrete gradient charge having a center explosive pellet of PBXN-5, a discrete layer of an oxidizer, a second discrete layer of the second fuel that includes coarse aluminum powder and an underlying first discrete layer of the first fuel that includes fine aluminum powder.

It is anticipated that a charge as shown in FIG. 5, that combines the fourth and fifth embodiments, wherein there are three discrete layers, would produce a discrete gradient charge having a sustained burn. As shown in the FIG. 5 there is a discrete layer 14 of the second fuel 15 that includes coarse aluminum powder, then inwardly a discrete oxidizer layer 16 of the oxidizer 17, and the innermost discrete layer 12 of the first fuel 13 that includes fine aluminum powder. Other combinations and iterations are anticipated, so long as the fine fuel layer is the first layer.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. An additive manufacturing (AM) process for making a discrete gradient charge, said process comprising:

acoustically mixing components of a first fuel comprised of: a fine aluminum powder and a curable binder, therein forming a first paste that is about 85% solids by weight;

building by additive manufacturing a discrete first layer that has a hollow cylindrical form with a first diameter by extruding a circular coiled stream of the first paste with a series of continuous overlapping passes of the first paste until a desired height is attained;

allowing the series of continuous overlapping passes of the first paste to meld and cure into a solid discrete first layer of the first fuel; and building by additive manufacturing a discrete second layer that has a second hollow cylindrical form with a second diameter, which is greater than the first diameter, by extruding the second paste also as a circular coiled stream with a series of continuous overlapping passes of the second paste until the desired height is attained.

2. The AM process according to claim 1, wherein the first paste is mixed by acoustically agitating the first fuel components at a frequency of about 60 Hz.

3. The AM process according to claim 1, further comprising:

acoustically mixing second components of a second fuel comprised of: a coarse aluminum powder and the curable binder therein, therein forming a second paste that is about 80% solids by weight;

stream with a series of continuous overlapping passes of and allowing the series of continuous overlapping passes of the second paste to meld and cure into a solid discrete second layer of the second fuel.

4. The AM process according to claim 3, wherein the second paste is mixed by acoustically agitating the components of the second fuel at a frequency of about 60 Hz.

5. The AM process according to claim 1, wherein a pellet of an explosive is positioned within the first diameter of the solid discrete first layer.

6. The AM process according to claim 3, wherein a pellet of an explosive is positioned within the first diameter of the solid discrete first layer.

7. The AM process according to claim 1, further comprising:

acoustically mixing oxidizer components comprised of: a powder of bismuth triiodate and the curable binder, therein forming an oxidizer paste that is about 92% solids by weight;

building by additive manufacturing a discrete over layer that has an outer hollow cylindrical form with a oxidizer diameter, which is greater than the first diameter, by extruding the oxidizer paste as a second circular coiled stream with a series of continuous overlapping passes of the oxidizer paste until the desired height is attained; and allowing the series of continuous overlapping passes of the oxidizer paste to meld and cure into a solid discrete oxidizer layer.

8. The AM process according to claim 7, wherein a pellet of an explosive is positioned within the first diameter of the solid discrete first layer.

9. The AM process according to claim 1, wherein the fine aluminum power has a median spherical diameter of about 3.5 microns.

10. The AM process according to claim 3, wherein the coarse aluminum power has a median spherical diameter of about 31.0 microns.

11. A discrete gradient charge, said charge comprising:

an inner discrete first hollow cylindrical layer of a solid first fuel that is comprised of about 85% by weight fine aluminum powder;

a second discrete hollow cylindrical layer of a solid second fuel that is comprised of about 80% by weight coarse aluminum powder;

a cured binder; and a pellet of an explosive positioned within the first hollow cylindrical layer.

12. The AM process according to claim 11, wherein the fine aluminum power has a median spherical diameter of about 3.5 microns.

13. The AM process according to claim 11, wherein the coarse aluminum power has a median spherical diameter of about 31.0 microns.

14. The discrete gradient charge according to claim 11, wherein said pellet is comprised of PBXN-5.

15. A discrete gradient charge, said charge comprising:

an inner discrete first hollow cylindrical layer of a solid first fuel that is comprised of about 85% by weight of a fine aluminum powder;

an outer discrete second hollow cylindrical layer of a solid oxidizer that is that is comprised of about 92% by weight bismuth triiodate;

a cured binder; and a pellet of an explosive positioned within the first hollow cylindrical layer.

16. The discrete gradient charge according to claim 15, wherein said explosive is PBXN-5.

17. An additive manufacturing (AM) process for making a gradient discrete charge, said process comprised of the steps of:

combining components comprised of: a fine aluminum powder with a curable binder, therein forming a first paste which is a first fuel;

building by additive manufacturing a discrete first layer creating a hollow cylindrical form with a first diameter, by extruding a circular coiled stream of the first paste with a series of continuous overlapping passes until a desired height is attained;

allowing the series of continuous overlapping passes to meld and cure into a solid discrete first layer of the first fuel;

combining components comprised of: a coarse aluminum powder with a suitable curable binder, therein forming a second paste which is a second fuel;

building by additive manufacturing a second discrete layer that has a second hollow cylindrical form with a second diameter by extruding a second circular coiled stream of the second paste with a second series of continuous overlapping passes until the desired height is attained; and allowing the second series of continuous overlapping passes to meld and cure into a solid discrete second layer of the second fuel.

18. An additive manufacturing process for making a gradient discrete charge, said process comprised of the steps of:

combining components comprised of: a fine aluminum powder with a curable binder, therein forming a first paste which is a first fuel;

building by additive manufacturing a discrete first layer creating an inner hollow cylindrical form with a first diameter, by extruding a circular coiled stream of the first paste with a series of continuous overlapping passes until a desired height is attained;

allowing the series of continuous overlapping passes to meld and cure into a solid discrete first layer of the first fuel;

combining oxidizer components comprised of: a powder of an oxidizer and a binder that be cured, therein forming an oxidizer paste;

building by additive manufacturing a discrete oxidizer layer that has an outer hollow cylindrical form with an oxidizer diameter, which is greater than the first diameter, by extruding a second circular coiled stream of the oxidizer paste with a second series of continuous overlapping passes until the desired height is attained; and allowing the second series of continuous overlapping passes to meld and cure into a solid discreet oxidizer layer.

19. The discrete gradient charge according to claim 16, wherein the median diameter of the fine aluminum is about 3.5 microns, wherein about 90% is less than or equal to 7.5 microns, and only about 10% is less than or equal to 1.8 microns.

20. The discrete gradient charge according to claim 16, wherein the median diameter of the coarse aluminum is about 31.0 microns, wherein about 90% is less than or equal to 58.0 microns, and only about 10% is less than or equal to about 15.0 microns.

* * * * *